United States Patent [19]

Sanford et al.

[11] 4,421,378

[45] Dec. 20, 1983

[54] ELECTRICAL CONTACT RETENTION INSERT AND MEANS FOR MOLDING SAME

[75] Inventors: Richard Sanford, Maryland; Normand C. Bourdon, Unadilla, both of N.Y.

[73] Assignee: The Bendix Corporation, Southfield, Mich.

[21] Appl. No.: 373,906

[22] Filed: May 3, 1982

Related U.S. Application Data

[63] Continuation of Ser. No. 92,132, Nov. 7, 1979, abandoned.

[51] Int. Cl.[3] ..... H01R 13/434

[52] U.S. Cl. ..... 339/217 R

[58] Field of Search ..... 339/217

[56] References Cited

U.S. PATENT DOCUMENTS

| | | | |
|---|---|---|---|
| 3,158,424 | 11/1964 | Bowen | 339/217 |
| 3,165,369 | 1/1965 | Maston | 339/59 |
| 3,200,355 | 8/1965 | Dahlen | 339/217 S X |
| 3,221,292 | 11/1965 | Swanson | 339/217 |
| 3,227,993 | 1/1966 | Bentley | 339/217 S X |
| 3,336,569 | 8/1967 | Nava | 339/217 R |
| 3,368,185 | 2/1968 | Dell | 339/217 |
| 3,631,375 | 12/1971 | Bridle | 339/217 S X |
| 3,638,165 | 1/1972 | Anhalt | 339/59 R |
| 3,697,934 | 10/1972 | Merry | 339/217 S |
| 3,708,780 | 1/1973 | Pierce | 339/217 S X |
| 3,721,943 | 3/1973 | Curr | 339/94 M |
| 3,727,172 | 4/1973 | Clark | 339/59 M |
| 3,971,613 | 7/1976 | Kobler | 339/59 R |
| 4,082,398 | 4/1978 | Bourdon | 339/59 M |
| 4,114,976 | 9/1978 | Selvin | 339/217 S |
| 4,157,806 | 6/1979 | Bourdon | 249/184 |
| 4,187,272 | 2/1980 | Bourdon | 264/318 |
| 4,187,605 | 2/1980 | Selvin | 29/629 |

FOREIGN PATENT DOCUMENTS

| | | | |
|---|---|---|---|
| 2816472 | 10/1978 | Fed. Rep. of Germany . | |
| 1451545 | 7/1966 | France | 339/217 S |
| 2200645 | 4/1979 | France . | |
| 1000854 | 8/1965 | United Kingdom . | |
| 1030091 | 5/1966 | United Kingdom . | |
| 1209719 | 10/1970 | United Kingdom . | |
| 1281009 | 7/1972 | United Kingdom | 339/59 R |
| 1339436 | 12/1973 | United Kingdom . | |
| 1371916 | 10/1974 | United Kingdom . | |
| 1358312 | 7/1979 | United Kingdom . | |

OTHER PUBLICATIONS

Product Engineering; vol. 42, No. 14, Sep. 1971, p. 53; Electrical Multiple Connector Combines 62 Parts Into One, H01R 13/42.

*Primary Examiner*—Eugene F. Desmond

*Attorney, Agent, or Firm*—Charles D. Lacina

[57] ABSTRACT

A one-piece dielectric insert 10 including an array of through passages 15 having formed at opposite ends thereof integral cavity means for removably securing a longitudinally slit C-shaped contact retention clip 29, the clip removably positioning a pin/socket contact for mating. An insert cavity 23 is defined by constriction means at one passage end for reducing the clip diameter and for preventing rearward movement of the clip and an abutment 21 at the other passage end for limiting forward movement of the clip. The constriction means comprises a pair of angularly separated shoulder housings 17 with each housing being coaxial with the passage and having a concave surface for engaging the clip to reduce the clip diameter.

10 Claims, 10 Drawing Figures

ELECTRICAL CONTACT RETENTION INSERT AND MEANS FOR MOLDING SAME

This is a continuation of application Ser. No. 92,132, filed Nov. 7, 1979, now abandoned.

BACKGROUND OF THE INVENTION

This invention relates to electrical connectors of the type having insertable and removable contacts. The invention is more particularly related to a means for the removable securing of an electrical contact retention device within an integral body of dielectric material. Additionally, a means for molding the integral dielectric insert with a core pin and core bushing is disclosed.

Electrical connectors generally include a plug and a receptacle, each of which has an insert of dielectric material within which electrical contacts are retained. The prior art under consideration addresses the insert means which were employed to secure electrical contact retention devices within a dielectric material and the means of molding these inserts.

Among the techniques often employed was the use of complex and intricate retaining mechanisms which were generally comprised of multiple pieces of dielectric material bonded together. When multiple pieces of dielectric are used, it is necessary to carefully seal the pieces together in order to eliminate the lower resistance paths and electrical breakdowns which occur between contacts along the interface of the pieces that form the retention clip insert. Examples of this method are disclosed in U.S. Pat. No. 3,727,172 and No. 3,638,165. The difficulties encountered with multiple pieces of dielectric bonded together to form an insert were partially overcome by minimizing the number of pieces of dielectric material required to fabricate an electrical connector insert. This technique is advanced in U.S. Pat. No. 4,082,398, assigned to the assignee of the present invention and incorporated by reference herein. Perhaps one of the most significant developments prior to this disclosure in the field of electrical connector retention means is found in U.S. Pat. No. 3,158,424. Among the teachings of this patent is the use of a flange, encompassing a full 360°, at the rearward edge of an insert passageway that is designed to hold an electrical connector retention clip within the bored section of an insert. This design, however, contains several drawbacks which become evident in the manufacture of the insert. It is taught that this insert can be molded with an annular member that is removable or dissolvable or otherwise disposable from the molded insert. Among the problems encountered in this method of manufacture is an inexactness in the length and positioning of the metal bushing being molded into the insert. After melting the bushing away from the insert, a standard length connector retention clip may not seat properly with the result that the entire insert must be scrapped. Another problem with this type of manufacturing method is that the metal bushings have to be cleaned thoroughly prior to molding the bushing into the insert. If any metal chips have not been cleaned from the bushings, they become molded into the insert and can cause electrical breakdowns within the insert. Another major problem with the use of metal bushings is that oxidation and static electricity are formed on the bushings. This results in obvious handling and molding difficulties.

The present invention eliminates the problems encountered with electrical failures within the inserts as well as those difficulties common to the manufacturing methods now employed.

SUMMARY OF THE INVENTION

An electrical connector insert 10 which is integrally molded from a dielectric material comprises a plurality of passages 15 which extend therethrough from a rear face 13 to a front face 11, a retention clip shoulder housing 17 near the rear face 13, and a rearwardly facing sleeve abutment 21 which reduces the bore of the passage 15. The shoulder housing 17 and sleeve abutment 21 form the rear and frontal boundaries of the retention clip cavity 23. The retention clip shoulder housing 17 in the passage 15 allows the close passing and securing of a contact retention clip 29 between the forward facing vertical wall 19 of the shoulder housing 17 and the rearward facing wall 22 of the abutment sleeve 21.

The contact retention clip 29 has at least two fingers 31 which, when mounted within the insert passage 15, are positioned forwardly and radially inward to form a resilient cone. When an electrical connector pin 33 with an elongated body having, as an integral part of its structure, an enlarged section 37 is entered into the passage 15 through the rear face 13, and through retention clip 29, the connector pin 33 causes these fingers 31 to be forced away from their rest position back against the walls of the passage 15. Once the enlarged section 37 is clear of the fingers 31, the forward wall 39 of the enlarged section 37 is in abutment with rearward facing wall 22 of the sleeve abutment 21 and the fingers 31 will return to their rest position against the rear wall 41 of the enlarged section 37. Thus, the connector pin 33 is removably secured between the sleeve abutment 21 and the retention clip fingers 31.

The passage 15 of insert 10 can be integrally molded, to incorporate all the features for the mounting of a retention clip 29 and connector pin 33 described above, by means of the herein disclosed core pin 53 and core bushing 61 configuration. The core pin 53 and core bushing 61 are matable and, when mated, produce an insert passage 15 mold which renders a shoulder housing 17, contact clip cavity 23, abutment 21, contact sleeve 25 and openings 27. Once the material used to mold the insert 10 is set, the core pin 53 can be withdrawn from the rear face 13 of passage 15 and the core bushing can be withdrawn through the contact sleeve 25 and the openings 27. No further tooling of the insert 10 is required. These means for molding the insert 10 can be mounted in different numbers and patterns to suit the type of connector shell 81 within which an insert 10 will be mounted.

It is an object of this invention to provide a means for removably securing the contact retention clips of an electrical connector insert by the use of an integral body.

It is another object of this invention to provide a simple and economical insert for an electrical connector.

It is another object of this invention to provide an insert of the type which permits each of its contact retention clips to be removed for repair and/or for replacement without damage to insert.

It is still another object of this invention to provide a clip retention mounting insert which permits the removal of an electrical contact from the retention clip while retaining the retention clip within the insert.

It is still another object of this invention to minimize the number of pieces required to fabricate an electrical connector insert.

It is yet another object of this invention to provide a molding means which is immediately reusable and requires no tooling between uses.

It is an additional object of this invention to provide a molding means which manufactures an integrally molded dielectric insert that requires no tooling after the removal from the molding means.

DETAILED DESCRIPTION

Figure 1:
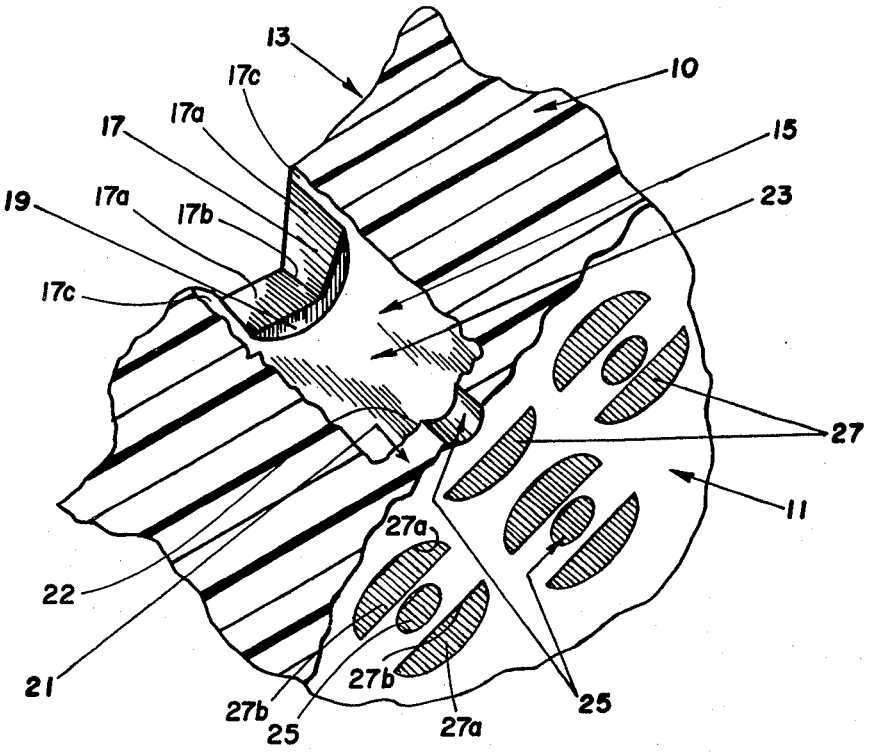
FIG. 1 is a partial cross-sectional diagrammatic view of an integrally molded dielectric insert designed to removably secure both a contact retention clip and a pin contact.

Referring now to the drawings, FIG. 1 illustrates a portion of an electrical connector insert that discloses one embodiment of the invention. The insert 10 consists of a body molded from a dielectric material. Generally, the dielectric insert is made from a thermoplastic resin, although other materials such as thermosetting materials may be used. Some examples of preferable materials are: polyester (Valox), polyarylsulfone (B 360 Astrel), polyethersulfone (Torlon), polymides (Nylon), acetates (Delrin), and polycarbonates (Lexan). The polyester material sold under the trade name "Valox" is preferred along with polyarylsulfones and polyethersulfones. The foregoing materials have acceptable mechanical strength and electrical insulation characteristics which serve to increase the dielectric separation between adjacent contacts.

The insert 10 has a plurality of passages 15 therethrough from a front face 11 to a rear face 13, the front face 11 being defined as that section of insert 10 which faces toward an engaged connector assembly and the rear face 13 as that side of the insert 10 opposite to front face 11. Extending axially forwardly from rear face 13 of insert 10 and into passage 15 and radially inwardly from (i.e., perpendicular to) the interior wall of passage 15 are at least two retention clip shoulder housings 17 (only one being shown). Each of the housings are equiangularly spaced around the passage to define a constriction to the passage. Each shoulder housing 17 includes a vertical wall 19 which faces vertical wall 22 of the axially separated sleeve abutment 21. That portion of passage 15 between vertical wall 19 of shoulder housing 17 and vertical wall 22 of sleeve abutment 21 forms a cavity 23 within which contact retention clip 29 is removably secured. Further, each shoulder housing 17 includes a concave surface which is coaxial to the passage, the pair of concave surfaces being disposed in confronting (i.e., superposing) relation. As shown, each concave surface includes a pair of flat, substantially horizontal, plate-like surfaces **17*a* which laterally angle away from a central axial line 17*b* to intersect the wall 17*c* of passage 15. The angular separation between the shoulder housings provide a rearward means whereby a flat bladed tool may enter for removing the contact clip by diametrical reduction through the constriction. These concave surfaces could also be semi-circular in shape. As shown best in FIG. 2, each of the walls 19, 22 are substantially perpendicular to the interior wall of passage 15. Vertical wall 19 of shoulder housing 17 may be angled rearwardly from an edge to form a lip (not shown) in the shoulder housing that will provide a recess for engaging the rear end face of retention clip 29. It should be noted that this lip would provide additional means for resisting axial cable forces imposed on contacts from pulling the clip outwardly of its cavity. Sleeve abutment 21 includes a contact support bore 25 which communicates with the cavity formed within the integrally dielectric insert. Vertical wall 22 of sleeve abutment 21, rather than presenting a surface perpendicular to the interior wall passage 15, could be angled forwardly (relative to the wall of passage 15) to form a second lip (not shown) to engage the forward end face of retention clip 29**.

Also shown in FIG. 1 are a plurality of "half-mooned" openings 27 which are formed during the molding of the integral insert. Each opening 27 communicates with cavity 23 and includes an arcuate wall **27*a* and a substantially flat chordal surface 27*b*, each arcuate wall 27*a* forming a coaxial continuation of the interior wall of passage 15. These openings 27 are generally symmetrically disposed at 180° to one another around the array of the contact support bores 25. Further and relative to passage 15, the pair of openings 27 at one passage end are substantially in register with the pair of shoulder housings 19 at the other passage end such that the angular extension of each arcuate wall 27*a* is substantially angularly co-extensive with the angular extension of each shoulder housing 19. That is, arcerate wall 27*a* forming opening 27 is substantially angularly coextensive with the angular extension of the shoulder housing 17 formed around the passage wall and between the intersection of flat surfaces 17*a* with the passage wall. These openings 27 provide a forward means whereby a tool, such as a pair of flat blades, may be received to diametrically reduce clip 29 and remove the clip rearwardly of insert 10. Openings 27 also provide a means through which the visual inspection of the forward seating and alignment of contact retention clips 29** is possible.

The shoulder housings 17 do not form a complete 360° lip at the rear face 13 of insert 10. Rather, shoulder housings 17 are in axial alignment with openings 27 and form a partial lip along the rear face 13 of insert 10. The flat surfaces 17*a* serve to diametrically reduce clip 29 for its entry into cavity 23 from rear face 13. As well as allowing entry of the clip into the cavity, the passage wall between (i.e., separating) each of the shoulder housings 17 provides a rearward means whereby a bladed tool may be received into the passage cavity to diametrically reduce clip 29 and to then remove the clip rearwardly of the insert. Depending upon the angular position of the clip within the cavity, removability may be required from the front face or from the rear face. As will be discussed, an interior longitudinal rib 32 may be provided to orient the angular position of the clip within the cavity. An additional benefit of this design is the capability of examining the insert vertical wall 19 of shoulder housing 17 through the openings 27.

Figure 2:
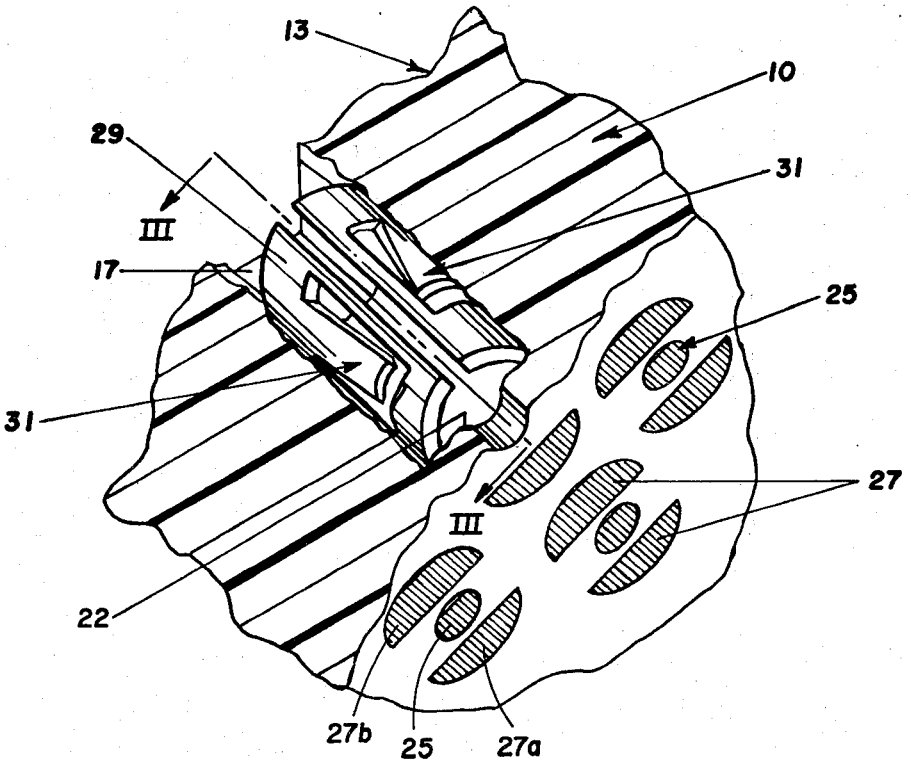
FIG. 2 is a partial cross-sectional diagrammatic view of the molded insert of FIG. 1 with a contact retention clip seated in the assembled position.

FIG. 2, another partial view of the electrical connector insert 10, shows a contact retention clip 29 installed within the cavity 23 section of the passage 15. It will be noted that clip 29 is not a completely enclosed cylinder, but rather has an opening along one full side. This opening permits a clip of resilient material to be slightly compressed in order to slide the clip between the shoulder housings 17 (only one shown in drawings) into the clip cavity 23. Once in place, the retainer clip 29 returns to its rest condition and is restricted in its lateral movement within the insert 10 by means of vertical wall 19 and the sleeve abutment 21. The fingers 31 of retention clip 29 are sections of the clip's 29 wall which point downwardly and forwardly forming a cone like configuration within the cavity 23.

Figure 3:
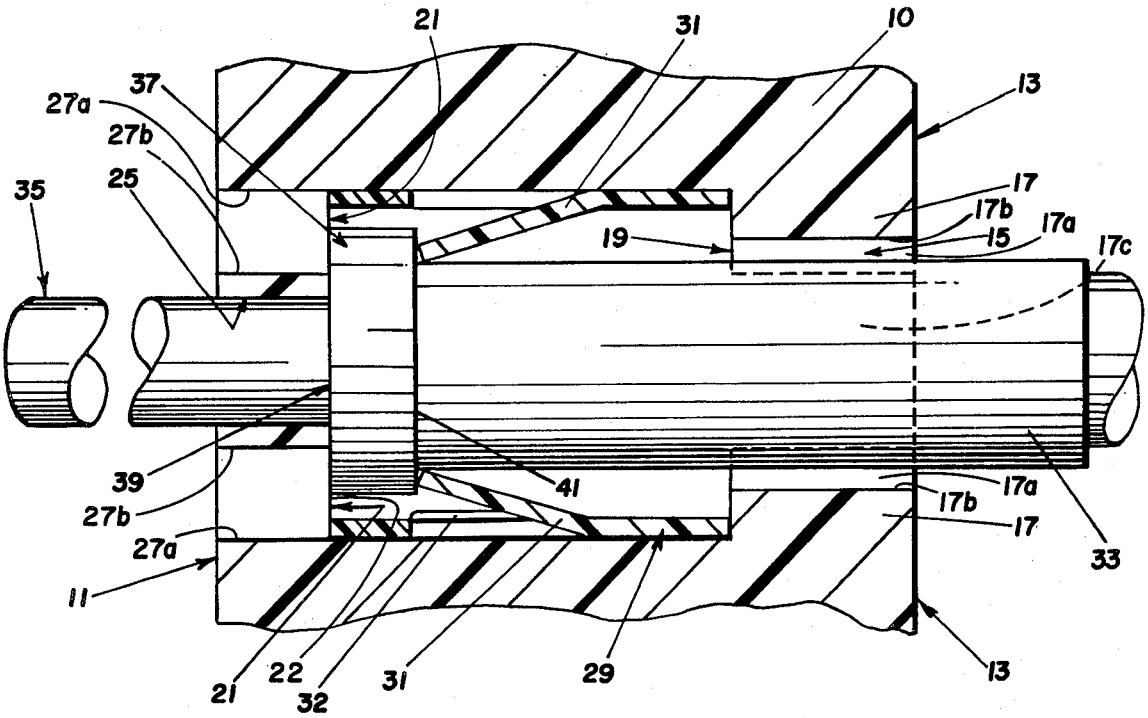
FIG. 3 is a cross-sectional view of an electrical pin contact engaged by a contact retention clip mounted within the molded insert.

In FIG. 3 the method by which a pin contact 33 is removably secured within the body of insert 10 is illustrated. Additionally illustrated is a contact retention clip 29 mounted within the cavity 23 of passage 15, being restricted from rotational movement within t he cavity 23 by means of the key 32 which extend axially along the wall of cavity 23 and engage the retention clip 29. More precisely, connector pin 33 enters through the rear face 13 of insert 10 and passes between the opposed shoulder housings 17. As connector pin 33 passes between the fingers 31 of retention clip 29, the enlarged section 37 pushes the fingers 31 out away from the center of the cavity, permitting the enlarged section 37 complete entry. When the forward wall 39 of enlarged section 37 is contiguous with the abutment 21, the fingers 31 will return to their rest position, engaging the rear wall 41 of the enlarged section 37. This will restrict lateral movement of the connector pin 33 within the insert 10. The terminal element 35 of connector pin 33 passes into and through the contact sleeve 25 in a close fitting relationship and extends beyond the front face 11 of insert 10 a sufficient distance to properly engage a socket contact. The shoulder housing 17 is in a spaced relationship to connector pin 33 and a tool can enter into the passage 15 therebetween. This tool will release connector pin 33 by forcing the fingers 31 away from their rest position, that is to say away from the rear wall 41 of enlarged section 37 and against the walls of clip 29. When this is accomplished, the connector pin 33 can be easily withdrawn from the insert 10.

Figure 4:
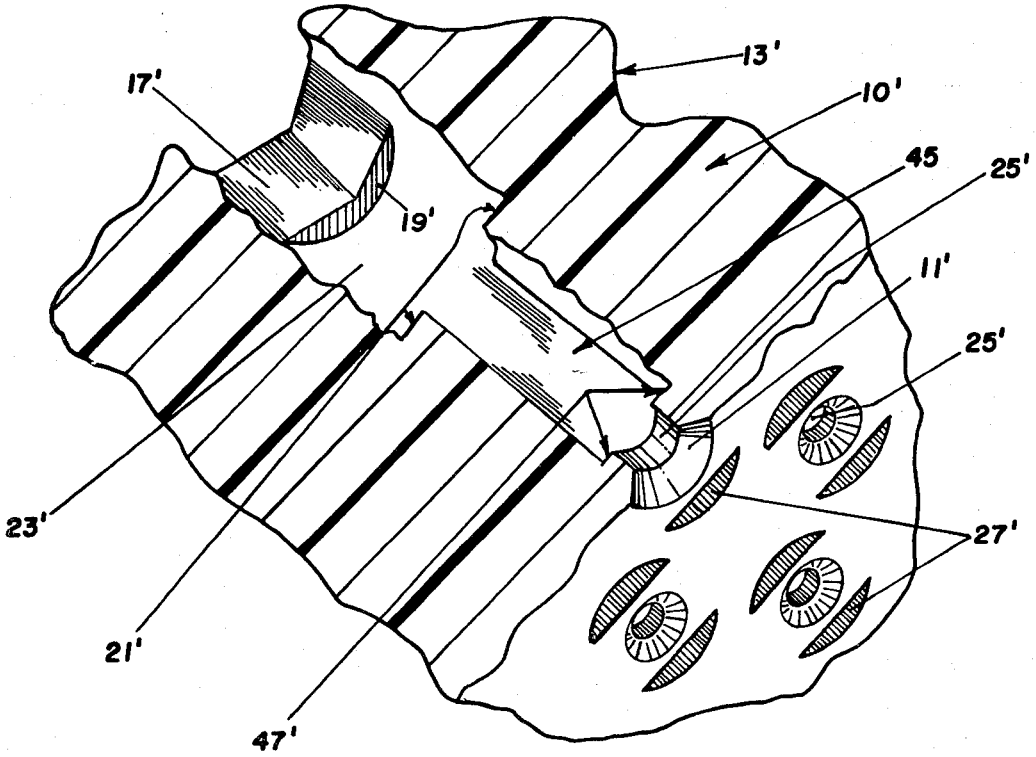
FIG. 4 is a partial cross-sectional diagrammatic view of an alternative embodiment of the invention which is molded to house an electrical socket contact.

FIG. 4 is an alternative embodiment of the insert 10' which is designed to receive and removably secure a socket contact 43. The principal difference lies in a socket bore 45 which rests between the front face of contact sleeve 25' and the abutment 21'. The contact retention clip 29' is removably mounted within the cavity 23' of insert 10' and restricted from lateral movement within the cavity 23' by abutment 21' and the vertical insert edge 19' of shoulder housing 17'. Whereas abutment 21' would be the same surface as the rearward face 47' of the contact sleeve 25' in the assembly employed for a contact pin 33, as displayed in FIGS. 1 through 3, the abutment 21' is now a separate entity. The rear face 47' of contact sleeve 25' can be sloped rearwardly from the walls of socket bore 45 to serve as a guide for a penetrating connector pin terminal element 35. A socket contact is removably secured by a retention clip 29' within the insert 10' with the same technique as depicted in FIG. 3. The insert 10' with a retention clip 29' and a connector socket 43 can be seen in this configuration in FIG. 10.

Figure 5:
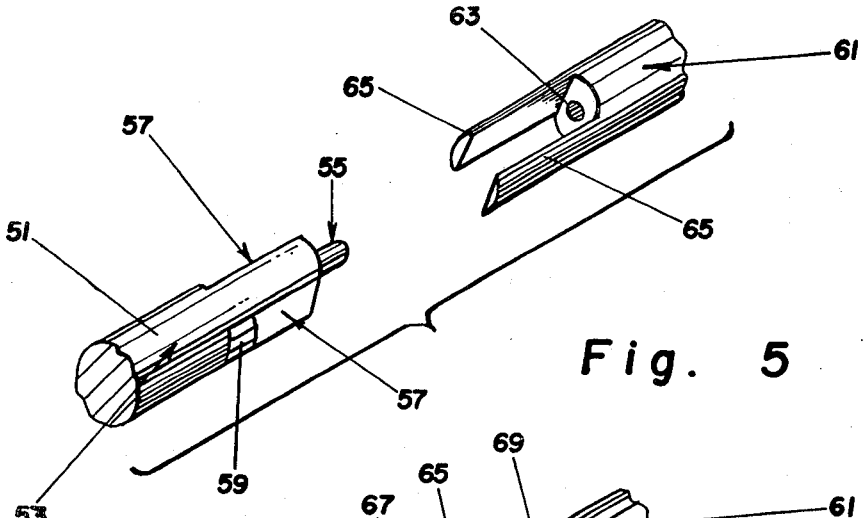
FIG. 5 is a schematic illustration of a separated core pin and bushing utilized in molding the clip retention insert used for a pin contact as in FIG. 1.
Figure 6:
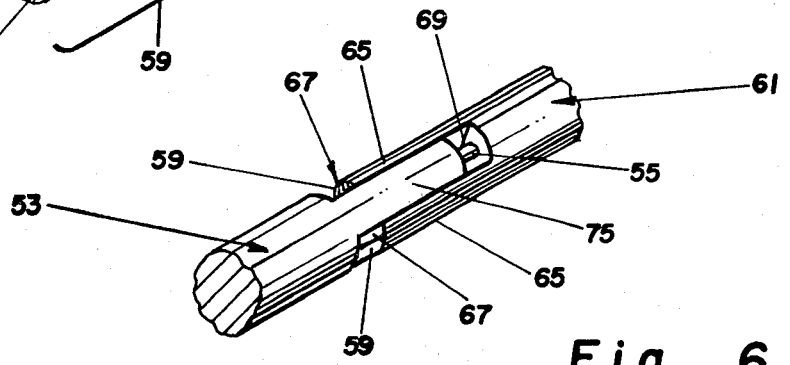
FIG. 6 is the mated view of the core and bushing of FIG. 5.

FIG. 5 illustrates a core pin 53 and a core bushing 61. The core pin 53 includes, at its forward edge, axial projection 55, at least two indented flat sides 57 and two shoulder forms 59 protruding from the rearward portion of the flat sides 57 and contiguous with the rear base section 51 of core pin 53. Core bushing 61 includes an axial bore 63, which is matable with the axial projection 55 and side fins 65 which have flat internal walls and curved exterior walls and are matable with the flat sides 57 of the core pin 53. In the mated condition of FIG. 6, the rearwardly facing edges of the side fins 65 will abut the forward edge of shoulder forms 59. The combination of the side fins 65 with the flat sides 57 will form a shaft like section of the mold which forms the contact retention clip cavity 23 in insert 10. In this alignment there will be an open area 69 around the axial projection 55 which has only partially penetrated bore 63. This open area 69 forms the front face 11 and the abutment 21 of the passage 15. The axial projection 55 forms the contact sleeve 25 of insert 10. The shoulder forms 59 form a shoulder housing mold area 67. This corresponds to the shoulder housing 17. The rearward edges of side fins 65 control the angle, if any, of the shoulder housing's vertical inward edge 19. Those sections of the side fins 65 which are in a spaced relationship adjacent to axial projection 55 form the openings 27 seen in the inserts front face 11. Upon completion of the molding process the core pin 53 and core bushing 61 can be separated and withdrawn from the insert 10. Core pin 53 is drawn out through the rear face 13 of insert 10. Core bushing 61 is drawn from the front face 11 of insert 10 and leaves the opening 27.

Several modifications can be incorporated within the core pin 53 and core bushing 61 in order to fabricate an insert with features that will enhance the retention clip mounting and securing capabilities of the insert 10. For example, the vertical inward edge 19 of shoulder housing 17, if angled rearwardly towards the passage walls, would provide a lip like structure which would act to positively engage the contact retention clip 29. This result can be obtained by bevelling the edges of the side fins 65 which abut shoulder form 59. The bevelled section would extend above and behind the shoulder forms 59 when the core pin and bushing are mated. Another method of increasing the contact retention clip 29 mounting capability of insert 10 could be achieved by forming a groove in one of the sections of the core pin 53 or bushing 61 which form the clip retention cavity 23. This groove would extend along the length of the member on which it was cut, axially from a point corresponding with the forward edge of core pin 53 to a point corresponding with the forward edge of protrusions 59. This will leave a protruding key within the cavity 23 integral with insert 10 which would align with the contact retention clip 29 when assembled. Such a design would allow a fixed location of the retention clip fingers 31 relative to the enlarged section 37 of the pin contact 33. These features can similarly be incorporated in the core and pin bushings presented in FIGS. 7 and 8 which are employed in molding an insert 10' used with socket contact 43. These core pins 53 and core bushings 61 can be multiply mounted in an endless variety of configurations as dictated by the number of contacts required and the dimensions of the plug in which the inserts are mounted.

Figure 7:
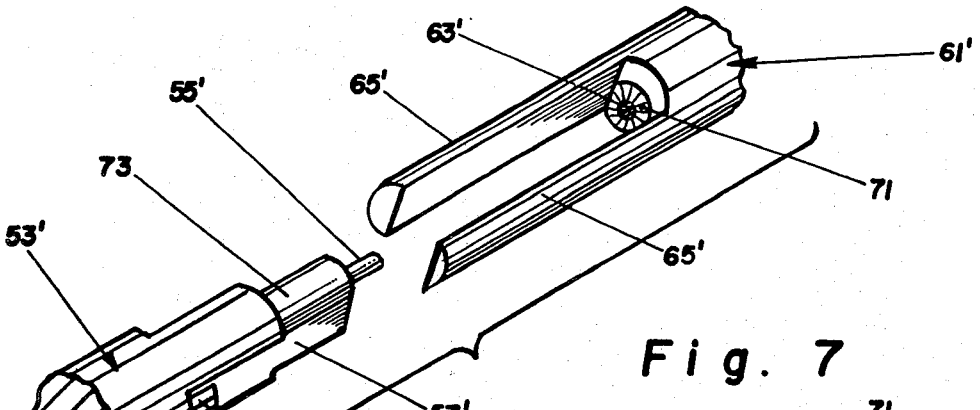
FIG. 7 is a schematic illustration of a separated core pin and bushing utilized in molding the clip retention insert used for a socket contact as in FIG. 4.
Figure 8:
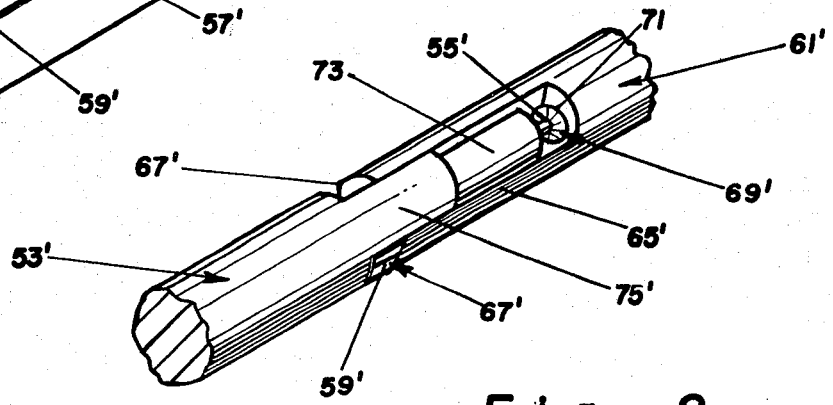
FIG. 8 is the mated view of the core and bushing of FIG. 7.

FIG. 7 illustrates a core pin 53' and a core bushing 61' which are utilized in the molding of an integral dielectric insert 10'. The core pin 53' includes a base portion 51' from which extends a shaft like portion which terminates in its forward end with axial projection 55'. At least two sides of the shaft like extensions are indented and flat 57'. In addition, a portion of this shaft has a reduced diameter which results in stepped sides 73. Also protruding from the flat sides 57' and in a contiguous relationship with the base 51' are shoulder forms 59'. The core bushing 61' includes at least two extending side fins 65' which are flat along their inside walls and curved along their outside walls, an axial bore 63' and a cone 71 which has its wide base in point having the axial bore 63'. The core pin 53' and core bushing 61' mate with the axial projection 55' penetrating the core 71 through axial bore 63'. Side fins 65' will abut the shoulder forms 59' and be aligned with and contiguous to the flat sides 57' of core pin 53'. This will provide a cavity 23' in the completed insert 10'. With this mated alignment there will be an open area 69' around the axial projection 55' which will form the front face 11' and the rearward face 47' of contact sleeve 25'. The axial projection 55' results in the contact sleeve 25'. The cone 71 creates a tapering extension with a cone-shaped mouth on the rearward face 47'. The cone shaped mouth can serve as a guide for the introduction of a pin contact terminal element 35. The steps 73 of core pin 51' form within the insert 10' a socket bore 45 which closely receives a socket contact. The vertical wall created by the different dimensions of step 73 and core pin 53' provides an abutment 21' within insert 10'. The section of the flat sides 57' contiguous with side fins 65' forms cavity 23' designed to receive a retention clip 29'. The protrusions 59', along with the portions of side fins 65' contiguous with the protrusions 59', form the shoulder housing 17' and vertical inward edge 19' of insert 10'. It should be noted that the modifications which can be introduced to core pin 53 and core bushing 61 are among the modifications which can be effected on core pin 53' and core bushing 61'.

Figure 9:
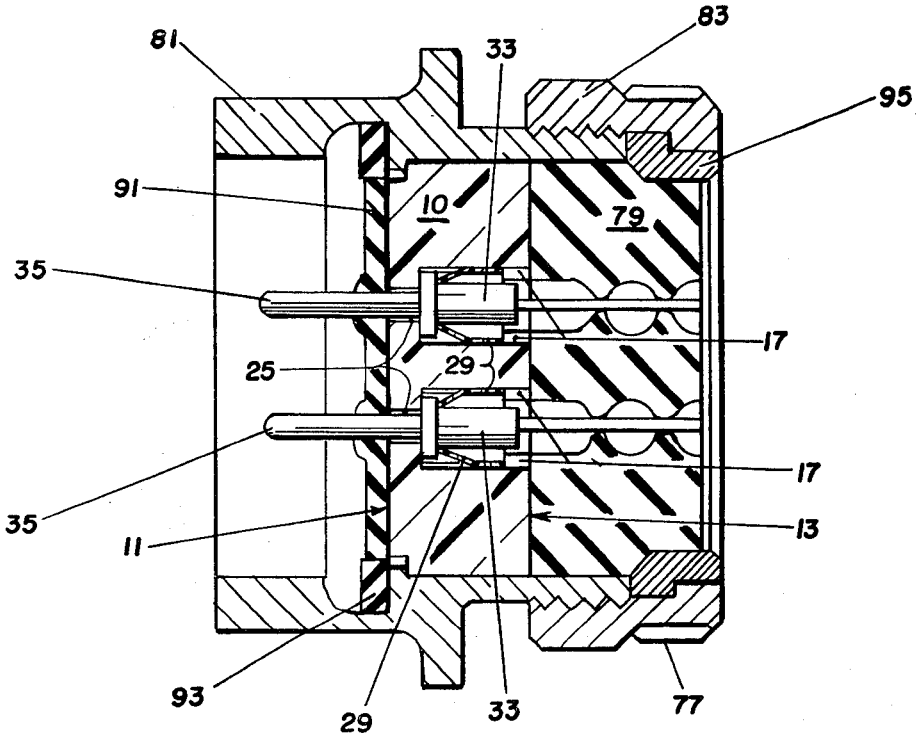
FIG. 9 is a molded dielectric insert, with retention clip and pin contact mounted, assembled in a typical electrical connector plug.

FIG. 9 illustrates an insert 10 that contains a plurality of connector pins 33 secured by retention clips 29. The insert 10 is mounted in a typical electrical connector plug assembly 77. Also shown are a rear moisture sealing grommet 79, an interfacial seal 91, a sealing gasket 93, a connector shell 81, a retaining nut 83 and a retaining ring 95.

Figure 10:
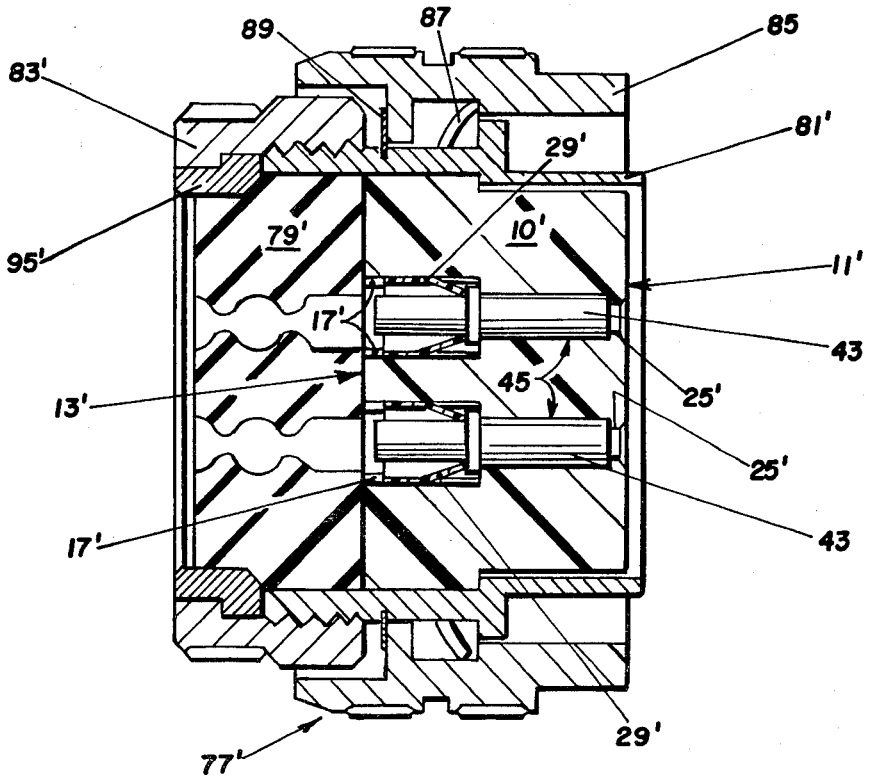
FIG. 10 is a molded dielectric insert with retention clip and socket contact mounted and assembled in a typical electrical connector plug such that the plugs in FIGS. 9 and 10 are matable.

FIG. 10 illustrates an integral dielectric insert 10' with connector socket 43 and contact retention clip 29' in a conventional socket assembly 77' which is matable with the conventional pin connector assembly of FIG. 9. Also shown are a rear moisture sealing grommet 79', a connector shell 81', a retaining nut 83', a retaining ring 95', a coupling nut 85, a wave washer 87 and a snap ring 89.

What is claimed is:

1. In an electrical connector insert for removably receiving an elongated electrical contact of the type having a retention section defining forward and rearward facing shoulders, said insert having an axial passage therethrough from a front face to a rear face to removably receive a resilient contact retention clip, said contact being removably secured within the passage by means of the resilient clip being received within said passage, said clip being longitudinally split to permit diametrical reduction and including resilient means to engage the rearward facing shoulder of the contact, the improvement wherein said insert comprises a dielectric body which has integrally formed therewith:

retention means disposed at opposite ends of said passage for retaining the retention clip within the insert, said retention means including a first vertical wall adjacent to said rear face for engaging one end of the clip and a second vertical wall adjacent to said front face for engaging the other end of the clip and the forward facing shoulder of said contact, said first vertical wall including at least two angularly spaced vertical wall portions;

constriction means extending radially inward into the passage for reducing the retention clip diameter, said constriction means including each said first vertical wall comprising a pair of flat surfaces which intersect with each other to form a concave V-shaped constriction, the flat surfaces forming the V-shaped constriction being coaxial with the passage and adapted to engage and bear against the outer clip wall to reduce the diameter of the clip;

support means adjacent to said front face for supporting a forward mating section of the contact; and means defining an opening in one of said vertical walls for receiving a release tool to diametrically reduce the clip diameter and thereby permit removal of the clip through the constriction, said opening being defined by said angularly spaced vertical wall portions.

2. In an electrical connector insert for receiving a plurality of elongated electrical contacts, each contact having an enlarged section defining two shoulders that face in opposite directions, said contacts being removably secured by means of a resilient clip mounted within said insert, said insert being comprised of dielectric material and defining a plurality of passages therethrough from a front face to a rear face, each passage being adapted to receive and axially retain a resilient contact retention clip, each of said retention clips being longitudinally slit to permit diametrical reduction and having a a resilient portion tapering radially inwardly to form means for engaging one of said contact shoulders, the improvement wherein said insert is integrally molded and has formed therewith:

a pair of angularly separated shoulder housings extending inwardly into the passage from the rear face, each shoulder housing forming a first vertical wall in the passage for engaging one end of the clip to prevent unwanted movement of the clip and a concave surface for engaging the outer wall of the clip to reduce the clip diameter, said concave surface being coaxial with the passage wall; and an abutment extending inwardly into the passage from the front face, said abutment forming a second vertical wall for engaging the other end of the clip, said second vertical wall being axially spaced from the first vertical wall of said shoulder housings to define therebetween a cavity within which the resilient clip is removably retained, said second vertical wall including a bore and a pair of half-mooned openings extending therethrough, the concave surface forming a passage constriction which engages the outer wall of the clip, said bore being coaxial with and forming a continuation of the passage and said half-mooned openings being disposed adjacent to the bore and in register with the first vertical walls of said pair of shoulder housings, said bore being adapted to receive a mating end of the contact, thereby reducing clip diameter for allowing clip insertability into and/or removability from the cavity.

3. The electrical connector insert as recited in claim 2 wherein said bore includes a stepped portion extending from the front face of the insert to a position spaced from the second vertical wall.

4. In an electrical connector apparatus for removably receiving an electrical contact of the type including a retention section defining a pair of oppositely facing shoulders, said apparatus comprising an insulative body having a front face, a rear face, and a passage extending between the faces and a C-shaped contact retention clip disposed within said passage for retaining the contact within the insert, said clip being longitudinally slit between each of its ends so as to permit diametrical reduction and including resilient means for engaging one of the contact shoulders, the improvement characterized by said insulative body being one-piece and having integrally formed therewith retention means defining a cavity for retaining the retention clip in the passage and constriction means defining a passage constriction communicating with the cavity for reducing the clip diameter, said retention means extending into the passage from each face of said insert and comprising a shoulder housing defining a first vertical wall adjacent to said rear face and a support shoulder defining a second vertical wall adjacent to said front face, the first and second vertical walls defining a cavity between the insert faces for axially positioning and retaining the clip, said constriction means including said shoulder housing having a concave surface coaxial to the passage axis and extending between said rear face and said first vertical wall, said concave surface being disposed radially inward of the passage wall and adapted to engage the clip wall to reduce the clip diameter whereby the clip may enter or leave the cavity, said shoulder housing forming a half-mooned sector by the concave surface extending laterally and radially to intersections with the passage wall, said insert comprising a pair of half-mooned sectors with each of said sectors being angularly separated to define an entryway for receiving a tool for reducing the clip diameter whereby the clip may be rearwardly removed from the cavity, said second vertical wall includes a pair of half-mooned openings which communicate through the shoulder housing and with the cavity, each half-mooned opening being in register and substantially coextensive with one respective half-mooned sectors, said half-mooned openings defining a second entryway for receiving a tool for reducing the clip diameter, whereby the clip may be rearwardly removed from the cavity.

5. The apparatus as recited in claim 4 further comprising means communicating with the cavity for receiving a tool to reduce the clip diameter for removal therefrom, said receiving means comprising one of said vertical walls including an opening therethrough.

6. In an electrical connector insert for removably receiving an elongated electrical contact of the type having a retention section defining forward and rearward facing shoulders, said insert having an axial passage therethrough from a front face to a rear face to removably receive a resilient contact retention clip, said contact being removably secured within the passage by means of the resilient clip being received within said passage, said clip being longitudinally split to permit diametrical reduction and including resilient means to engage the rearward facing shoulder of the contact, the improvement wherein said insert comprises a dielectric body which has integrally formed therewith;

retention means disposed at opposite ends of said passage for retaining the retention clip within the insert, said retention means including a first vertical wall adjacent to said rear face for engaging one end of the clip and a second vertical wall adjacent to said front face for engaging the other end of the clip and the forward facing shoulder of said contact, said first vertical wall including at least two angularly spaced vertical wall portions;

constriction means extending axially inwardly into the passage from said rear face for reducing the retention clip diameter;

support means adjacent to said front face for supporting a forward mating section of the contact, said support means including said second vertical wall including a bore coaxial with the passage and extending therethrough; and means defining an opening in one of said vertical walls for receiving a release tool to diametrically reduce the clip diameter and thereby permit removal of the clip through the constriction, said receiving means including said second vertical wall including a pair of half-mooned openings disposed about the bore and extending therethrough, said half-moon openings in said second vertical wall being in register with and substantially the same size as the angularly spaced vertical wall portions defining said first vertical wall.

7. An electrical connector insert device which may be used in plug and/or receptacle connector shells, said electrical connector insert comprising:

a body of insulating material having a passageway extending from a front face to a rear face and including radially inwardly formed stop means between said end faces;

a one-piece metallic sleeve located within said passageway and having radially inward extending resilient means cooperating with said stop means for positioning an electrical contact within said sleeve and body of insulating material, the sleeve having a slot extending longitudinally from end to end to allow diametrical reduction of said sleeve; and said stop means comprising a pair of angularly spaced, vertically rising, half-mooned abutment walls extending radially inward into the passage, the vertical walls being adapted to abut the other end of the sleeve for retaining the sleeve within the passageway and the half-mooned surfaces being adapted to diametrically reduce the sleeve so as to allow it to be compressed and fit within the passageway.

8. An electrical connector comprising:

an insulator having a plurality of passages extending therethrough from a front face to a rear face thereof;

a contact retention clip having a longitudinally extending seam extending from a front end to a rear end thereof to thereby allow the clip to diametrically reduce, said clip having a radially deflectable retention finger extending inwardly into the passage;

a contact in at least one of said passages, said contact having formed thereon a shoulder adapted to be engaged by said finger, the improvement characterized by:

means defining forward and rearward vertical walls for captivating the clip in the passage;

means defining a constricted opening in one of said walls for reducing the clip diameter to thereby allow the clip to be inserted or removed from the passage, said reducing means comprising a concave surface extending radially inward relative to the opening; and means communicating with the passage from either vertical wall for receiving a tool to reduce the clip diameter for removal through said one vertical wall.

9. The electrical connector as recited in claim 8 wherein said reducing means comprises a pair of concave surfaces extending radially inward relative to said opening with each concave surface being angularly separated one from the other.

10. The electrical connector as recited in claim 8 wherein said means for receiving a tool comprises a pair of half-mooned openings which extend axially through said other vertical wall, the curved portion of each half moon forming a coaxial continuation of said passage whereby a tool inserted axially therein reduces the clip diameter for removal through said one vertical wall.

* * * * *